United States Patent [19]

DeSantis

[11] 4,262,833

[45] Apr. 21, 1981

[54] CARTRIDGE POUCH

[76] Inventor: Eugene DeSantis, 20 Wellington Rd., Greenvale, N.Y. 11548

[21] Appl. No.: 120,394

[22] Filed: Feb. 11, 1980

[51] Int. Cl.[3] ..... F42B 39/00

[52] U.S. Cl. ..... 224/239; 224/223; 224/229; 224/918; 206/3; 206/315 R

[58] Field of Search ..... 224/239, 203, 223, 228, 224/229, 236, 249, 918; 150/34; 206/3, 443, 315 R

[56] References Cited

U.S. PATENT DOCUMENTS

| | | | |
|---|---|---|---|
| 109,365 | 11/1870 | King | 224/239 X |
| 759,125 | 5/1904 | Palmer | 224/203 |
| 1,703,139 | 2/1929 | Falcone et al. | 206/315 X |
| 2,346,185 | 4/1944 | Perry | 224/239 |
| 2,383,748 | 8/1945 | Sherman | 224/229 X |
| 2,413,580 | 12/1946 | Perry | 206/3 |
| 2,763,411 | 9/1956 | Werner | 224/239 X |
| 3,272,412 | 9/1966 | Antonious | 224/249 X |
| 3,777,954 | 12/1973 | Theodore | 224/239 X |
| 3,917,135 | 11/1975 | Christensen | 224/249 X |
| 4,047,650 | 9/1977 | Domingos | 224/223 |

*Primary Examiner*—Steven M. Pollard

*Attorney, Agent, or Firm*—Dayton R. Stemple, Jr.

[57] ABSTRACT

Belt mountable cartridge pouch for fast convenient release of cartridges, wherein cartridge pockets are formed by merely placing slots in the original pouch blank, and folding the blank along the longitudinal axis of said slot to form and mold the pockets.

7 Claims, 4 Drawing Figures

CARTRIDGE POUCH

FIELD OF THE INVENTION

This invention relates to new and useful improvements in a cartridge pouch or dump box that is mounted and worn on a person's belt and more particularly seeks to provide a simplified unit that may be produced if desired from a single rectangular leather blank in which aligned cartridge pockets are made by die cutting a slot in the original blank that is subsequently formed to ultimately provide cartridge pockets that permit easy, quick and convenient cartridge removal by single hand action by a wearer of the cartridge pouch.

DESCRIPTION OF PRIOR ART

Some types of cartridge belts and cartridge pouches mountable on regular belts have been designed in the prior art to have cartridges readily available or be snapped open by the wearer to conveniently then release cartridges into one hand of the wearer for subsequent insertion into a hand gun that is being controlled by the other hand. Such pouches are shown in U.S. Pat. Nos. 2,763,411 and 3,777,954, for example.

SUMMARY OF THE INVENTION

In contrast to the prior art, this invention provides a removeable belt mountable cartridge pouch in which the cartridge pockets are simply formed by die-cutting slots from the original leather blank, then folding the blank along the longitudinal axis of the slots to form two laminated walls except for cartridge pockets molded or formed snugly about the desired cartridges.

If desired, one rectangular leather blank may be used to form the entire unit, although of course the different walls may be formed from different pieces and stitched or otherwise fastened together at the base. A three-walled unit may be made wherein the middle wall serves both as a cartridge pocket and belt wall or a four-walled unit wherein two walls surround the belt and the remaining two form the cartridge pockets.

OBJECTS OF THE INVENTION

It is an object of the invention to provide a belt mountable cartridge pouch wherein the cartridge pockets per se are formed merely by placing die-cut slots in the original blank, then folding the leather blank along the longitudinal axis of the die-cut slots to form laminated walls, except for the space between the walls and near the slot that is molded or formed snugly around cartridges or dummies to provide snug cartridge pockets.

It is a further object of this invention to provide a cartridge pouch from which cartridges may be easily extracted for feeding into a hand gun.

It is also an object of this invention to provide a cartridge pouch which may be formed from a single rectangular blank if desired or from a plurality of blanks that are attached to each other at the base.

With these and other objects, the nature of which will be apparent, the invention will be more fully understood by reference to the drawings, the accompanying detailed description, and the appended claims.

DESCRIPTION OF THE PREFERRED EMBODIMENTS

Figure 1:
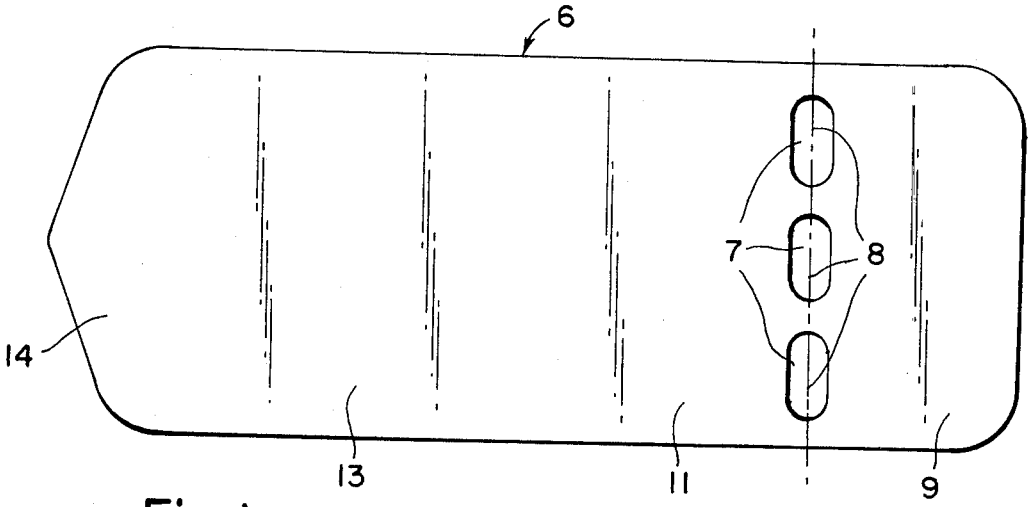
FIG. 1 is a plan view of a single rectangular blank that is used to form the cartridge pouch of this invention.

Referring to the drawings in detail, the invention is illustrated in two different embodiments, both of which utilize the basic concept of forming cartridge pockets from slots cut in the original blank and having said blank folded along the longitudinal axis of those slots to form two laminar walls with space between to define the cartridge pockets.

Figure 2:
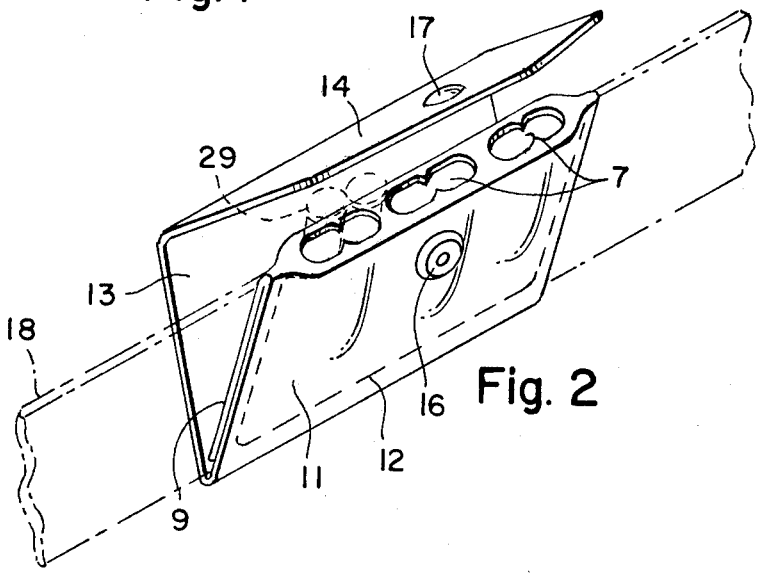
FIG. 2 is a perspective view of a partially open belt mounted cartridge pouch formed from the blank of FIG. 1.

The modification of FIGS. 1 and 2 is formed from a blank 6 made from leather, plastic or other pliable material in which three slots 7 have been die-cut, and have a longitudinal axis 8 extending therethrough. This blank is folded along the longitudinal axis 8 to form an inner-pocket, outer-belt wall 9 and exterior pocket wall 11 that are stitched at 12 or otherwise laminated together to leave space for cartridge pockets between the walls immediately below slots 7.

The remaining portion of blank 6 is formed into a rear belt wall 13 which is hinged freely to exterior pocket wall 11 and a closing flap 14 which is hinged freely to the rear belt wall 13. Closing flap 14 and exterior belt wall 11 are provided with associated male 16 and female 17 snap fasteners, which obviously may be substituted with other means of fastening that is quickly detachable such as "Velcro", for example.

As is shown in FIG. 2, the entire unit is detachably secured to belt 18 by folding so that inner-pocket, outer-belt wall 9 abuts the front surface of the belt and rear belt wall 13 contacts the rear surface of belt 18. When the snap is opened, the closing flap 14 is raised and the cartridge pockets are rotated forward with the same hand as far as the operator desires so that the cartridges 29 may be pulled upwardly or horizontally in pairs if he desires or if the unit is further rotated the cartridges tend to fall downwardly into the hand of the operator, giving him quick and easy access to the cartridges within the pockets defined by slots 7. The cartridges 29 are shown in slots for two cartridges each, which is believed to be the most convenient number for handling by an operator. Obviously, the slots can be changed to hold single, triple or more cartridges.

Figure 4:
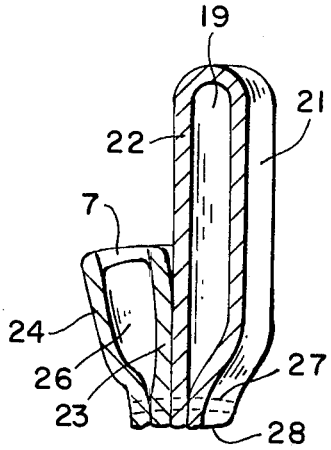
FIG. 4 is a cross-section taken along line 4—4 of FIG. 3.
Figure 3:
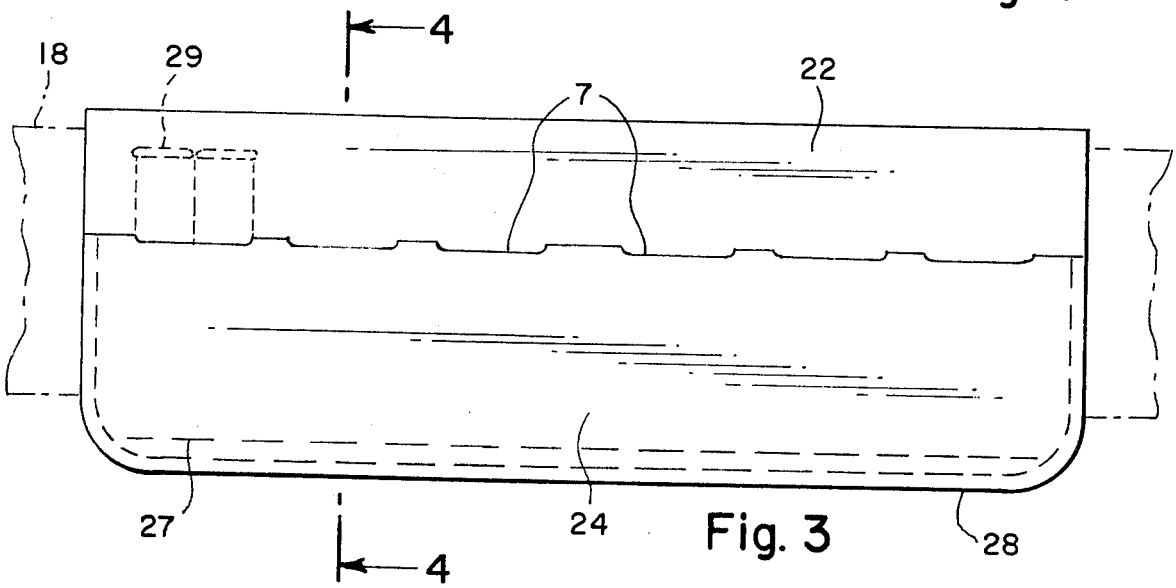
FIG. 3 is a plan view of a modified cartridge pouch formed from two blanks.

The second embodiment shown in FIGS. 3 and 4 is a longer unit that does not have a closing flap so that belt 18 must be threaded through space 19 formed between rear belt wall 21 and front belt wall 22. Slots 7 are formed as before by folding rear pocket wall 23 and front pocket wall 24 along the longitudinal axis of the slots to form the cartridge pocket space 26 but to otherwise contact each other.

This unit can also be formed from a single piece of leather but as shown is formed from two pieces of leather all of which are stitched together at 27 near the base 28. Cartridges 29 are shown partly within the pockets in FIG. 2 and just entering the pockets in FIG. 4.

The blank 6 of FIG. 1 or the blanks for FIG. 4 are die-cut from soft leather (natural or softened with working liquids as desired), then folded or shaped into the final configuration with cartridges or dummy molds placed into the appropriate cartridge pockets, and then placed in a press and dried in an oven so that the desired shape of the final unit and particularly the cartridge pockets are set during the drying or curing in the oven. In this way, the cartridge pockets snugly fit the cartridges to hold same but also to release same readily when pulled by the operator's fingers. Thus, the slots as seen in FIG. 2 are shaped somewhat different than when freshly die-cut as seen in FIG. 1.

The cartridge pocket portion shown in FIG. 4 is obviously not as readily rotated as that shown in FIG. 2 because in FIG. 4 there is no fastening or closing flap and when force is not being applied by hand, the cartridges must remain more or less vertical so that they will not fall from their pockets. It is possible to apply force by hand however to rotate the cartridges to a position where the cartridges are more easily removed from the pockets.

I claim:

1. A belt mountable cartridge pouch comprising a first wall adapted to lie behind said belt, a second wall secured to and spaced from said first wall and adopted to lie in front of said belt, a third wall secured at the bottom and adapted to lie in front of said first wall, and a fourth wall laminated to, secured at the bottom to and adapted to line in front of said third wall, said third and fourth wall being formed from a single panel being folded at the top edge of each wall over against each other, a slot being cut in said top edge before folding with its longitudinal axis along the folding line, and space being provided between said third and fourth walls below said slot that is formed to fit snugly around cartridges to be releasably carried in said slot and space.

2. In a belt mountable cartridge pouch having a plurality of parallel flexible walls when attached to said belt at least one of which is adapted to be positioned behind said belt, and two other of said walls are adapted to be positioned in front of said belt, the improvement wherein said other two walls are formed from a single panel being folded at the top to be form said two other walls laminated against each other, said panel having a slot cut therein before folding with the longitudinal axis of said slot coinciding with the fold line, and space being provided between said walls below said slot that is formed to fit snugly around cartridges to be releasably carried in said slot and space.

3. In a belt mountable cartridge pouch having at least two parallel adjacent plies adapted to rest in front of said belt, the improvement comprising forming said two plies from a single panel folded along the top edge of said two plies and having a slot cut in said panel before said folding with the longitudinal axis of said slot coinciding with the fold line, and space being provided between said walls below said slot that is formed to fit snugly around cartridges to be releasably carried in said slot and space.

4. The cartridge pouch of claim 3 having a plurality of said slots.

5. The cartridge pouch of claim 4 wherein each slot is adapted to hold two cartridges.

6. The cartridge pouch of claim 3 wherein said two plies are pivotal as a unit about their lower longitudinal axis.

7. The cartridge pouch of claim 6 wherein said two plies are readily pivotal by a single hand that also withdraws said cartridges after the pivotal motion.

* * * * *